US008733775B1

(12) United States Patent
Brand

(10) Patent No.: US 8,733,775 B1
(45) Date of Patent: May 27, 2014

(54) PHYSICAL THERAPY ASSEMBLY

(71) Applicant: Nicholas J. Brand, Charlotte, NC (US)

(72) Inventor: Nicholas J. Brand, Charlotte, NC (US)

(73) Assignee: Nicholas Brand, Charlotte, NC (US)

( * ) Notice: Subject to any disclaimer, the term of this patent is extended or adjusted under 35 U.S.C. 154(b) by 0 days.

(21) Appl. No.: 13/622,470

(22) Filed: Sep. 19, 2012

(51) Int. Cl.
*A47C 7/50* (2006.01)

(52) U.S. Cl.
USPC ..... 280/304.1; 280/250.1; 280/291; 423/423.19; 423/423.17; 423/423.3

(58) Field of Classification Search
USPC ..... 280/304.1, 250.1, 291; 297/423.19, 297/423.17, 423.3, 423.34, 423.35, 723.37, 297/423.29
See application file for complete search history.

(56) References Cited

U.S. PATENT DOCUMENTS

| | | | | | |
|---|---|---|---|---|---|
| 694,538 | A * | 3/1902 | Eddy | 297/423.22 |
| 2,598,985 | A * | 6/1952 | Everest et al. | 297/423.33 |
| 2,746,527 | A * | 5/1956 | Liebich | 297/423.4 |
| 3,212,817 | A * | 10/1965 | Sully | 297/423.37 |
| 3,301,595 | A * | 1/1967 | Jennings, Jr. | 297/423.38 |
| 4,033,624 | A * | 7/1977 | Jun | 297/423.3 |
| 4,351,540 | A | 9/1982 | Minnebraker | |
| D273,376 | S | 4/1984 | Charles | |
| 4,712,836 | A * | 12/1987 | Gerber | 297/423.37 |
| 4,770,432 | A * | 9/1988 | Wagner | 280/250.1 |
| 5,033,793 | A | 7/1991 | Quintile | |
| 5,259,664 | A | 11/1993 | Cottle | |
| D351,576 | S | 10/1994 | Brooks | |
| 5,378,041 | A * | 1/1995 | Lee | 297/391 |
| 5,711,580 | A | 1/1998 | Barclay et al. | |
| 6,273,443 | B1 * | 8/2001 | Fleigle | 280/304.1 |
| 7,360,840 | B2 | 4/2008 | Barlow et al. | |
| 7,367,578 | B2 * | 5/2008 | Jansen | 280/304.1 |
| 7,487,989 | B2 | 2/2009 | Crosby, II | |
| 8,231,090 | B2 * | 7/2012 | Cramer | 248/229.14 |
| 2007/0057561 | A1 * | 3/2007 | Liao | 297/423.19 |

* cited by examiner

*Primary Examiner* — Tashiana Adams
*Assistant Examiner* — Michael Stabley

(57) ABSTRACT

A Physical therapy assembly includes a wheelchair that may transport a user. A pad is movably coupled to the wheelchair so the pad may support the user's leg.

1 Claim, 4 Drawing Sheets

PHYSICAL THERAPY ASSEMBLY

BACKGROUND OF THE DISCLOSURE

Field of the Disclosure

The disclosure relates to a physical therapy devices and more particularly pertains to a new a physical therapy device for supporting a user's legs.

SUMMARY OF THE DISCLOSURE

An embodiment of the disclosure meets the needs presented above by generally comprising a wheelchair that may transport a user. A pad is movably coupled to the wheelchair so the pad may support the user's leg.

There has thus been outlined, rather broadly, the more important features of the disclosure in order that the detailed description thereof that follows may be better understood, and in order that the present contribution to the art may be better appreciated. There are additional features of the disclosure that will be described hereinafter and which will form the subject matter of the claims appended hereto.

The objects of the disclosure, along with the various features of novelty which characterize the disclosure, are pointed out with particularity in the claims annexed to and forming a part of this disclosure.

BRIEF DESCRIPTION OF THE DRAWINGS

The disclosure will be better understood and objects other than those set forth above will become apparent when consideration is given to the following detailed description thereof. Such description makes reference to the annexed drawings wherein.

DESCRIPTION OF THE PREFERRED EMBODIMENT

Figure 1:
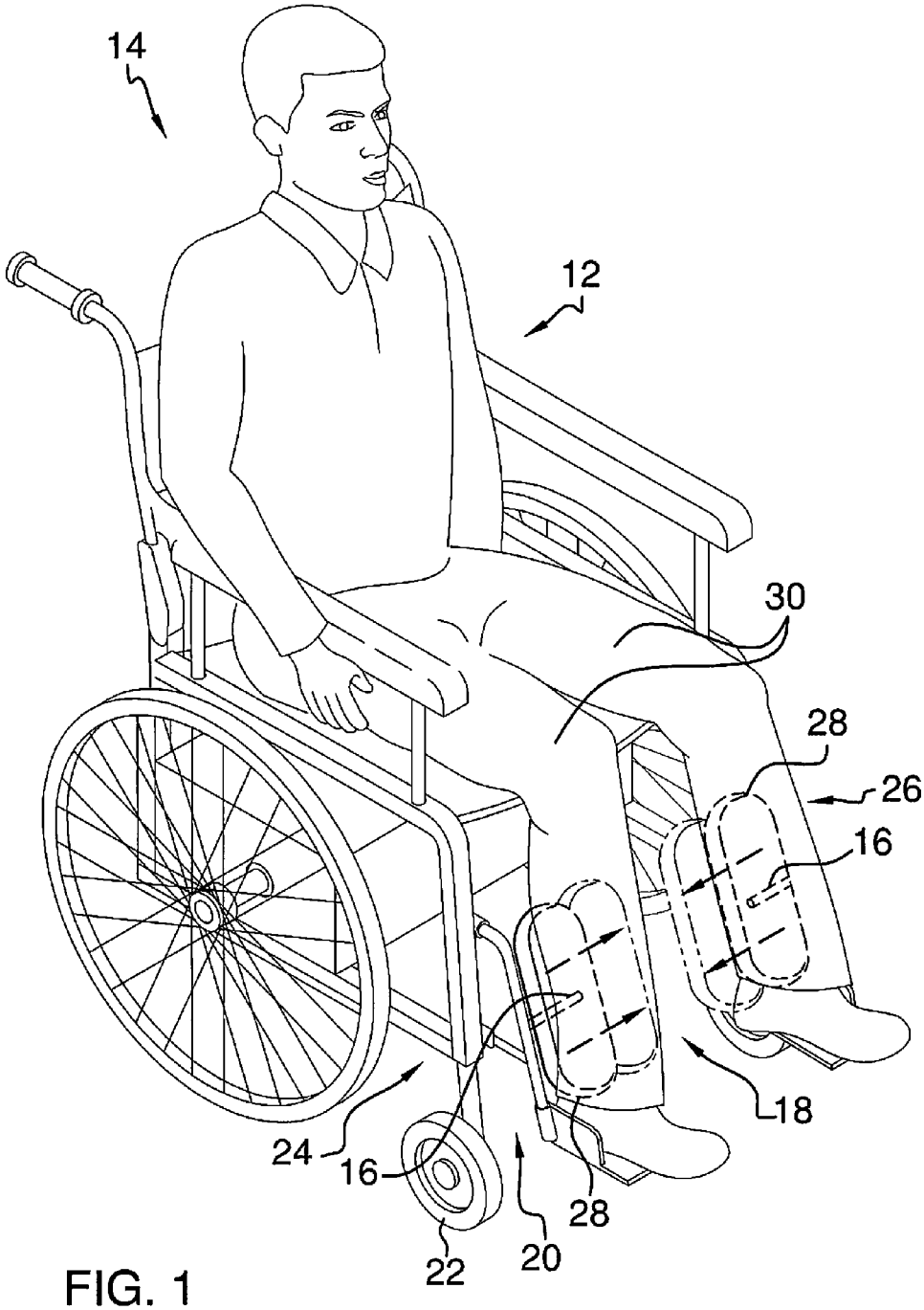
FIG. 1 is a perspective view of physical therapy assembly according to an embodiment of the disclosure.
Figure 2:
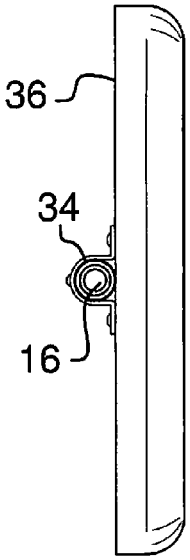
FIG. 2 is a right side view of an embodiment of the disclosure.
Figure 3:
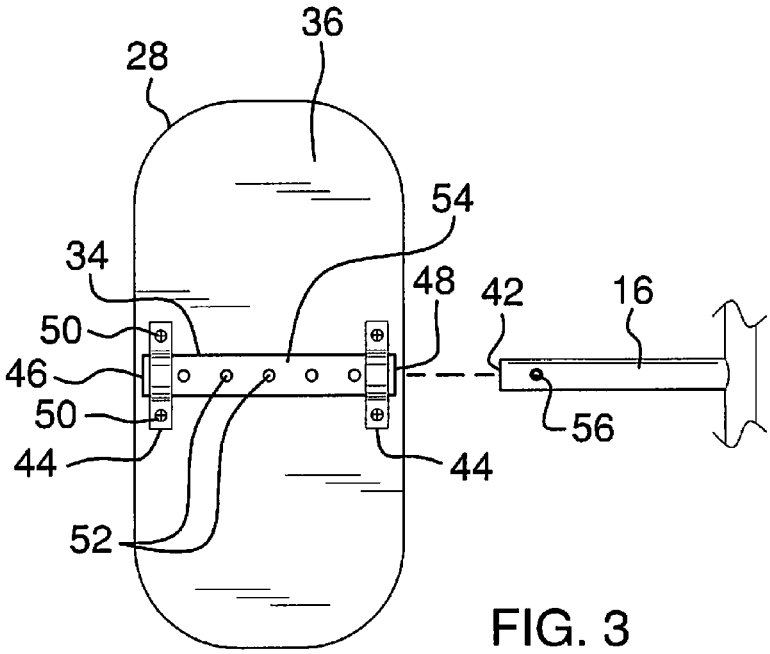
FIG. 3 is a back view of an embodiment of the disclosure.
Figure 4:
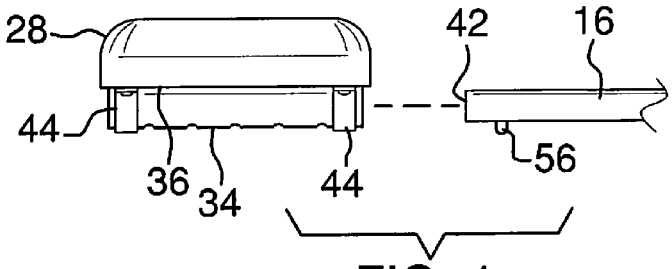
FIG. 4 is a top view of an embodiment of the disclosure.
Figure 5:
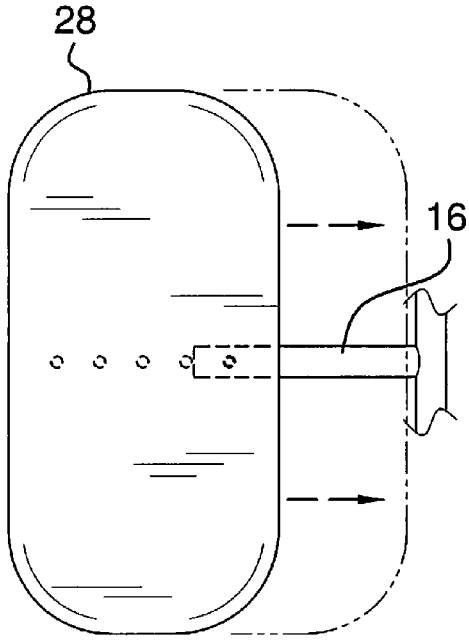
FIG. 5 is a front view of an embodiment of the disclosure.
Figure 6:
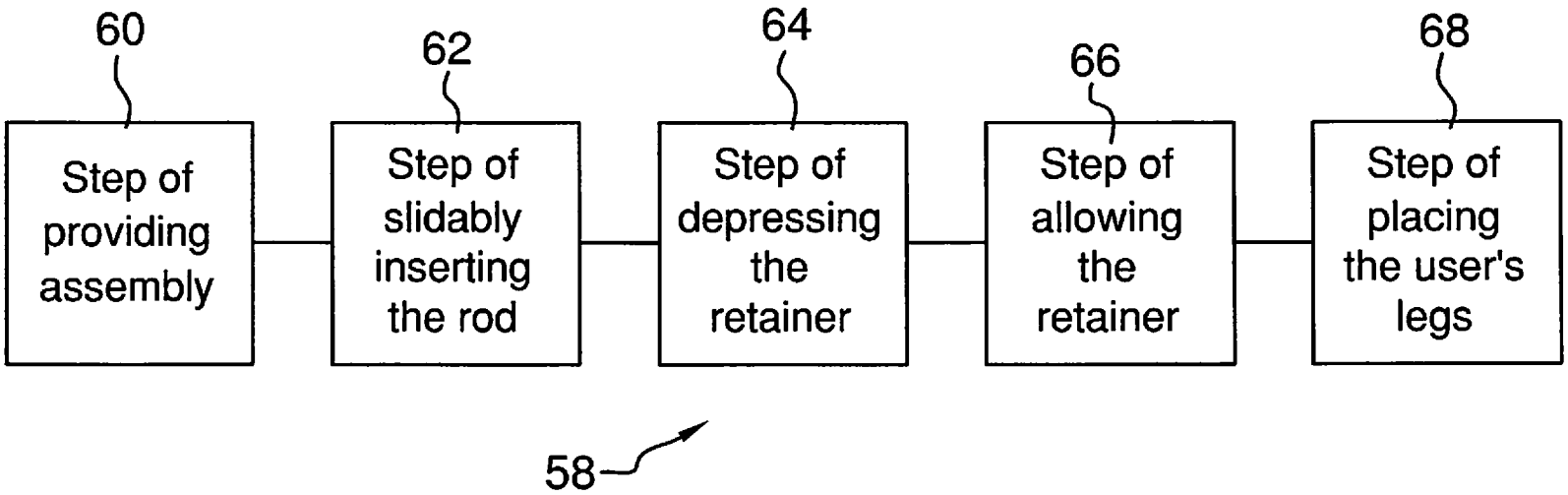
FIG. 6 is a schematic view of method of utilizing an embodiment of the disclosure.

With reference now to the drawings, and in particular to FIGS. 1 through 6 thereof, a new a physical therapy device embodying the principles and concepts of an embodiment of the disclosure and generally designated by the reference numeral 10 will be described.

As best illustrated in FIGS. 1 through 6, the Physical therapy assembly 10 generally comprises a wheelchair 12 configured to transport a user 14. The wheelchair 12 may be of any conventional design. A rod 16 is coupled to a front 18 of the wheelchair 12. The rod 16 is positioned proximate a bottom 20 of the wheelchair 12 and a front wheel 22 of the wheelchair 12. The rod 16 is one of a pair of rods 16. Each of the rods 16 extends inwardly from an associated one of a first 24 and a second 26 lateral side of the wheelchair 12.

A pad 28 is movably coupled to the wheelchair 12 so the pad 28 may support one of the user's legs 30. The pad 28 may be positioned on the wheelchair 12 so the user's calf 32 abuts the pad 28. The pad 28 is one of a pair of pads 28 and each of the pads 28 may support an associated one the user's legs 30.

Each of the pads 28 may be comprised of a resiliently compressible material so each of the pads 28 may cushion the user's legs 30.

A tube 34 is coupled to a back 36 of the pad 28 so the tube 34 extends between a first lateral side 38 and a second lateral side 40 of the pad 28. The tube 34 insertably receives a free end 42 of the rod 16 so the pad 28 is slidably coupled to the rod 16. The tube 34 is one of a pair of tubes 34. Each of the tubes 34 is coupled to the back 36 of an associated one of the pair of pads 28. A pair of couplers 44 are each positioned proximate a first end 46 and a second end 48 of the tube 34. A pair of fasteners 50 extends through each of the couplers 44 and engages the back 36 of the pad 28 so the couplers 44 may retain the tube 34 on the pad 28.

A plurality of retainer apertures 52 extends through an exterior wall 54 of the tube 34. The plurality of retainer apertures 52 is evenly distributed between the first end 46 and the second end 48 of the tube 34. A retainer 56 is movably coupled to the rod 16 proximate the free end 42 of the rod 16. The retainer 56 extends upwardly through a selected one of the plurality of retainer apertures 52 so the pad 28 is retained at a selected position on the rod 16. The retainer 56 is one of a pair of retainers 56. Each of the retainers 56 is movably coupled to an associated one of the pair of rods 16.

In use, the assembly 10 allows for a method 58 of adjustably supporting the user's legs 30 on the wheelchair 12. The steps of the method 58 comprise a step 60 of providing the wheelchair 12, the pair of pads 28, the pair of tubes 34 coupled to the back 36 of each of the pads 28, the plurality of retainer apertures 52 extending through each of the tubes 34, the pair of rods 16 coupled to the wheelchair 12 and the retainers 56 movably coupled to each of the rods 16. The method 58 further includes a step 62 of slidably inserting the free end 42 of each of the rods 16 into the associated one of the pair of tubes 34. Additionally, the method 58 includes a step 64 of depressing the retainer 56 such that the retainer 56 abuts an inner surface 66 of the associated one of the tubes 34. The method 58 also includes a step 68 of allowing the retainer 56 to extend upwardly through a selected one of the retainer apertures 52. Each of the tubes 34 is retained at the selected position on the associated one of each of the rods 16 such that each of the pads 28 is aligned with the associated one of the user's legs 30. Finally, the method 58 includes a step 70 of placing each of the user's legs 30 on the associated one of the pads 28.

With respect to the above description then, it is to be realized that the optimum dimensional relationships for the parts of an embodiment enabled by the disclosure, to include variations in size, materials, shape, form, function and manner of operation, assembly and use, are deemed readily apparent and obvious to one skilled in the art, and all equivalent relationships to those illustrated in the drawings and described in the specification are intended to be encompassed by an embodiment of the disclosure.

Therefore, the foregoing is considered as illustrative only of the principles of the disclosure. Further, since numerous modifications and changes will readily occur to those skilled in the art, it is not desired to limit the disclosure to the exact construction and operation shown and described, and accordingly, all suitable modifications and equivalents may be resorted to, falling within the scope of the disclosure.

I claim:

1. A physical therapy assembly comprising:

a wheelchair configured to transport a user;

a rod coupled to a front of said wheelchair, said rod being positioned proximate a bottom of said wheelchair, said rod being one of a pair of said rods, each of said rods extending inwardly from an associated one of a first and a second lateral side of said wheelchair;

a pad movably coupled to said wheelchair wherein said pad is configured to support the user's leg, said pad being one of a pair of said pads;

a tube coupled to a back of said pad wherein said tube extends between a first lateral side and a second lateral side of said pad, said tube insertably receiving a free end of said rod wherein said pad is slidably coupled to said rod, said tube being one of a pair of said tubes, each of said tubes being coupled to an associated one of said pair of pads;

a plurality of retainer apertures extending through an exterior wall of said tube, said plurality of retainer apertures being evenly distributed between a first end and a second end of said tube; and a retainer movably coupled to said rod proximate said free end of said rod, said retainer extending upwardly through a selected one of said plurality of retainer apertures wherein said pad is retained at a selected position on said rod, said retainer being one of a pair of said retainers, each of said retainers being movably coupled to an associated one of said pair of rods.

* * * * *